US009277819B1

(12) United States Patent
Pirkl

(10) Patent No.: US 9,277,819 B1
(45) Date of Patent: Mar. 8, 2016

(54) SLIDING SHELF CONTAINMENT SYSTEM

(71) Applicant: Gerald William Pirkl, Henderson, NV (US)

(72) Inventor: Gerald William Pirkl, Henderson, NV (US)

( * ) Notice: Subject to any disclaimer, the term of this patent is extended or adjusted under 35 U.S.C. 154(b) by 0 days.

(21) Appl. No.: 14/537,900

(22) Filed: Nov. 10, 2014

Related U.S. Application Data

(60) Provisional application No. 61/908,188, filed on Nov. 25, 2013, provisional application No. 61/965,331, filed on Jan. 29, 2014.

(51) Int. Cl.

| | |
|---|---|
| ***A47F 5/00*** | (2006.01) |
| ***A47F 5/08*** | (2006.01) |
| ***A47B 96/02*** | (2006.01) |
| ***A47F 3/06*** | (2006.01) |
| ***A47B 45/00*** | (2006.01) |
| ***A47B 57/00*** | (2006.01) |
| ***A47F 5/01*** | (2006.01) |
| ***A47F 5/10*** | (2006.01) |
| ***A47B 57/58*** | (2006.01) |
| ***A47F 9/00*** | (2006.01) |

(52) U.S. Cl.

CPC ..... *A47B 96/025* (2013.01); *A47B 45/00* (2013.01); *A47B 57/00* (2013.01); *A47B 57/58* (2013.01); *A47F 3/06* (2013.01); *A47F 5/005* (2013.01); *A47F 5/0043* (2013.01); *A47F 5/0056* (2013.01); *A47F 5/01* (2013.01); *A47F 5/08* (2013.01); *A47F 5/10* (2013.01); *A47F 9/005* (2013.01)

(58) Field of Classification Search

CPC ..... A47B 96/025; A47B 97/00; A47B 45/00; A47B 96/02; A47B 96/022; A47B 96/027; A47B 57/00; A47B 57/58; A47B 58/583; A47B 57/585; A47B 57/586; A47B 47/00; A47B 47/021; A47B 47/022; A47B 55/02; A47B 88/20; A47B 96/00; A47B 2088/202; A47B 88/0014; A47B 88/0018; A47B 96/16; A47F 3/06; A47F 3/14; A47F 5/0043; A47F 5/0081; A47F 5/01; A47F 5/08; A47F 5/10; A47F 5/13; A47F 5/14; A47F 9/005; A47F 3/147; A47F 5/0018; A47F 5/0031; A47F 5/005; A47F 5/0056; A47F 5/0068; A47F 5/0025; A47F 7/148; A47J 47/16

USPC ..... 211/134, 175, 184, 43, 90.01–90.04, 211/193, 75, 106, 106.01, 87.01, 86.01, 211/181.1, 150, 126.15, 119.003, 45, 46, 211/88.01, 88.02; 312/205, 348.1–348.4; 248/200

See application file for complete search history.

(56) References Cited

U.S. PATENT DOCUMENTS

| | | | | | |
|---|---|---|---|---|---|
| 1,136,331 | A * | 4/1915 | Harding | 211/106 | |
| 1,741,928 | A * | 12/1929 | Gafney | 211/106 | |
| 1,770,836 | A * | 7/1930 | Boote | B42F 15/0035 312/348.3 | |
| 1,936,517 | A * | 11/1933 | Vernon | 62/466 | |
| 4,901,972 | A * | 2/1990 | Judd et al. | 248/639 | |
| 5,037,163 | A * | 8/1991 | Hatcher | 312/323 | |
| 5,230,554 | A * | 7/1993 | Camilleri | 312/334.6 | |
| 5,494,175 | A * | 2/1996 | Higdon | B42F 15/0094 211/46 | |
| 5,921,410 | A * | 7/1999 | Emery et al. | 211/88.01 | |
| 6,109,462 | A * | 8/2000 | Emalfarb et al. | 211/119 | |

(Continued)

*Primary Examiner* — Jennifer E Novosad

(74) *Attorney, Agent, or Firm* — Jonathan M. Rixen; Lemaire Patent Law Firm, P.L.L.C.

(57) ABSTRACT

Mechanisms and methods to install upper restrictive barriers onto existing pull-out shelves to prevent or decrease the likelihood of the shelf contents from falling over the back or sides of the shelf.

20 Claims, 7 Drawing Sheets

(56) References Cited

U.S. PATENT DOCUMENTS

| | | | | |
|---|---|---|---|---|
| 6,364,136 | B1 * | 4/2002 | Weshler et al. | 211/90.02 |
| 6,505,749 | B1 * | 1/2003 | Panetta et al. | 211/86.01 |
| 7,806,277 | B2 * | 10/2010 | Mimlitch et al. | 211/26 |
| 7,942,486 | B2 * | 5/2011 | Petri | 312/333 |
| 8,430,253 | B1 * | 4/2013 | Jackson et al. | 211/90.03 |
| 8,807,355 | B2 * | 8/2014 | Merey | 211/175 |
| 2007/0095768 | A1 * | 5/2007 | Huo | 211/113 |
| 2007/0138116 | A1 * | 6/2007 | Metcalf | 211/90.01 |
| 2008/0074021 | A1 * | 3/2008 | Croft et al. | 312/334.1 |

* cited by examiner

SLIDING SHELF CONTAINMENT SYSTEM

FIELD OF THE INVENTION

The present invention relates to shelves, and in particular to systems and methods for containing objects placed on a sliding shelf.

BACKGROUND OF THE INVENTION

There are no specifications that relate to dimensional qualities of slide out shelves. Typical sliding shelves are custom built for their needed application. When we think of slide out shelves, kitchen food storage, pots and pans, cleaning products, laundry supplies, garage storage, and other storage applications come to mind. Custom built slide out shelves for these applications are usually constructed from a wood or laminate, or combination thereof. Typical shelves sides are random heights, but the majority of products that I have researched, have what the industry refers to as the height of the width of a credit card. This translates to two and a quarter inches (5.7 cm)—plus or minus. There are custom built installations that have taller sides, and depending on the total height between the floor of the sliding shelf, in question, and the bottom of the shelf above it, may not need this invention. My research shows that the vast majority of owners of typical slide out shelves have a problem with objects falling off the shelves when in operation.

A Patent Search has been conducted by an independent patent attorney, studying items that relate to 'Sliding Shelf and Barrier.' The closest U.S. Patent is U.S. Pat. No. 6,039,422. Other sliding shelf patents reviewed are: U.S. Pat. Nos. 7,942,486; 7,806,277; 6,364,136; 5,230,554; 5,037,163; and 4,901,972. His written opinion claims that he did not find any patented products that fit the description of my invention.

Two Provisional Patents 61/908188 and 61/965331, have been submitted for two different versions of this invention. I have included both of them in this one Non-Provisional Submittal.

BRIEF SUMMARY OF THE INVENTION

The advantages of this invention are to eliminate or greatly reduce materials falling over the edge or sides of slide out shelves.

DETAILED DESCRIPTION OF THE INVENTION

FIGS. 1A, 1B, 1C and 1D relate to the first embodiment corresponding to Provisional Application 61/908,188.

1. The sliding shelf, front, back, sides, and bottom, are existing elements of a conventional sliding shelf unit.
2. Sliding shelves are built in random lengths and widths, and this invention will accommodate units from 12.0 inches to 22.5 inches (30.5 cm to 57.2 cm) in length and 12.0 inches to 30.0 inches (30.5 cm to 76.2 cm) in width. Standard two rail system can accommodate an 8-inch (20.3-cm) sliding-shelf space. A three rail system can accommodate up to an 11-inch (27.9-cm) space.
3. Element 115 (also referred to herein as a containment member)—telescoping rail of metal or rigid material, to accommodate shelf varying widths and lengths.
4. Drawings for this embodiment are: FIG. 1A, FIG. 1B, FIG. 1C, and FIG. 1D.

Figure 1A:
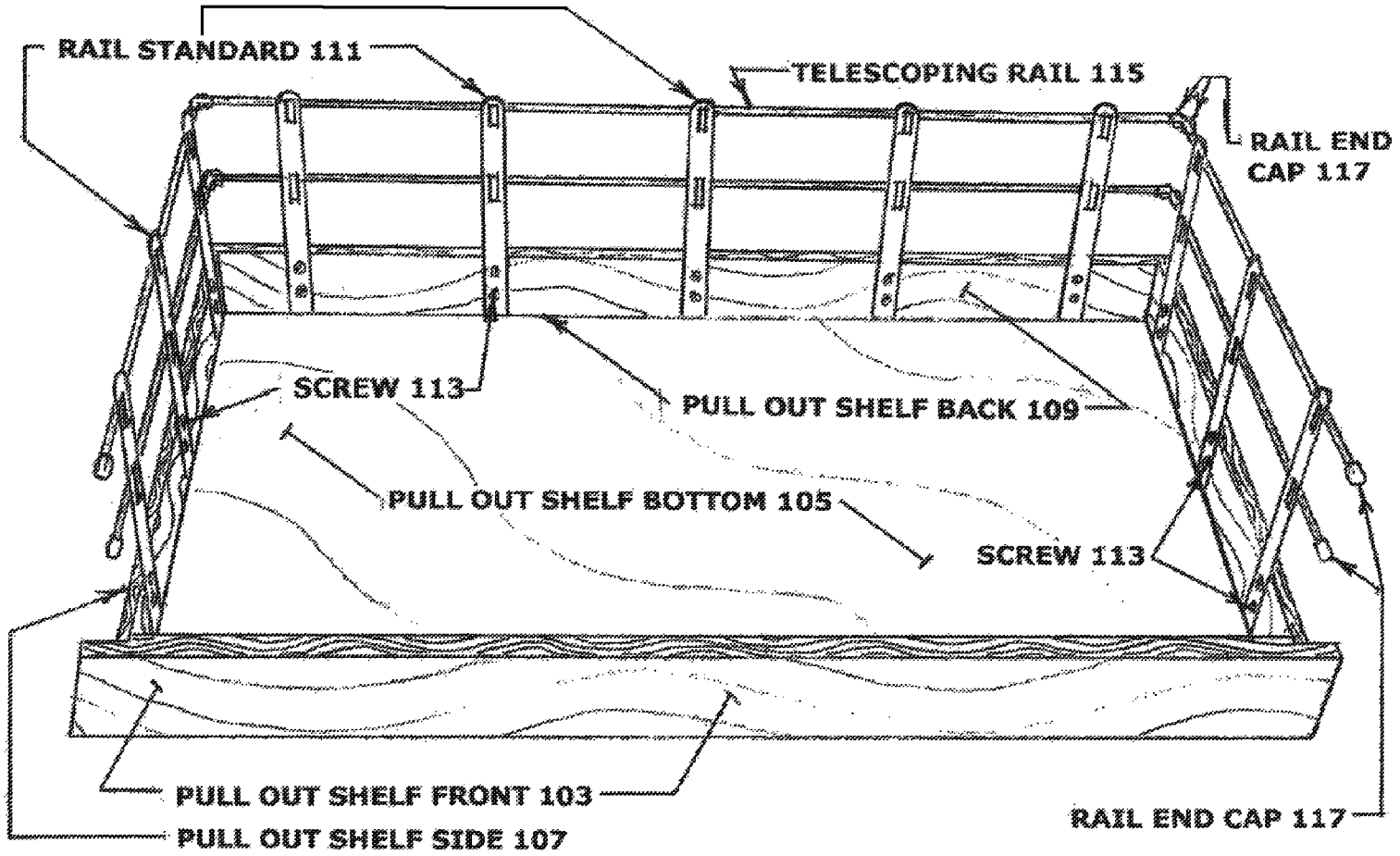
FIG. 1A is a top oblique view of a sliding shelf, shown with a rail containment system 101 according to one embodiment of the present invention.

FIG. 1A is a top oblique view of a sliding shelf and a rail containment system 101.

1. Existing sliding shelf, elements 103 front, 105 bottom, 107 side, and 109 back.
2. Element 111 (also referred to herein as a containment-member support)—rail standard—is attached to the shelf sides and back, every four to six inches, with screws, and holds the rails in place.
3. Element 113—self tapping, #8, ½ inch lath screws, attach rail standards 111 to sides and back of sliding shelf.
4. Element 115—telescoping rail of metal or rigid material, to accommodate shelf varying widths and lengths.
5. Element 117—rail end cap of rubberized or plastic material, to close off the ends of the rails, and eliminate sharp edges.

Figure 1B:
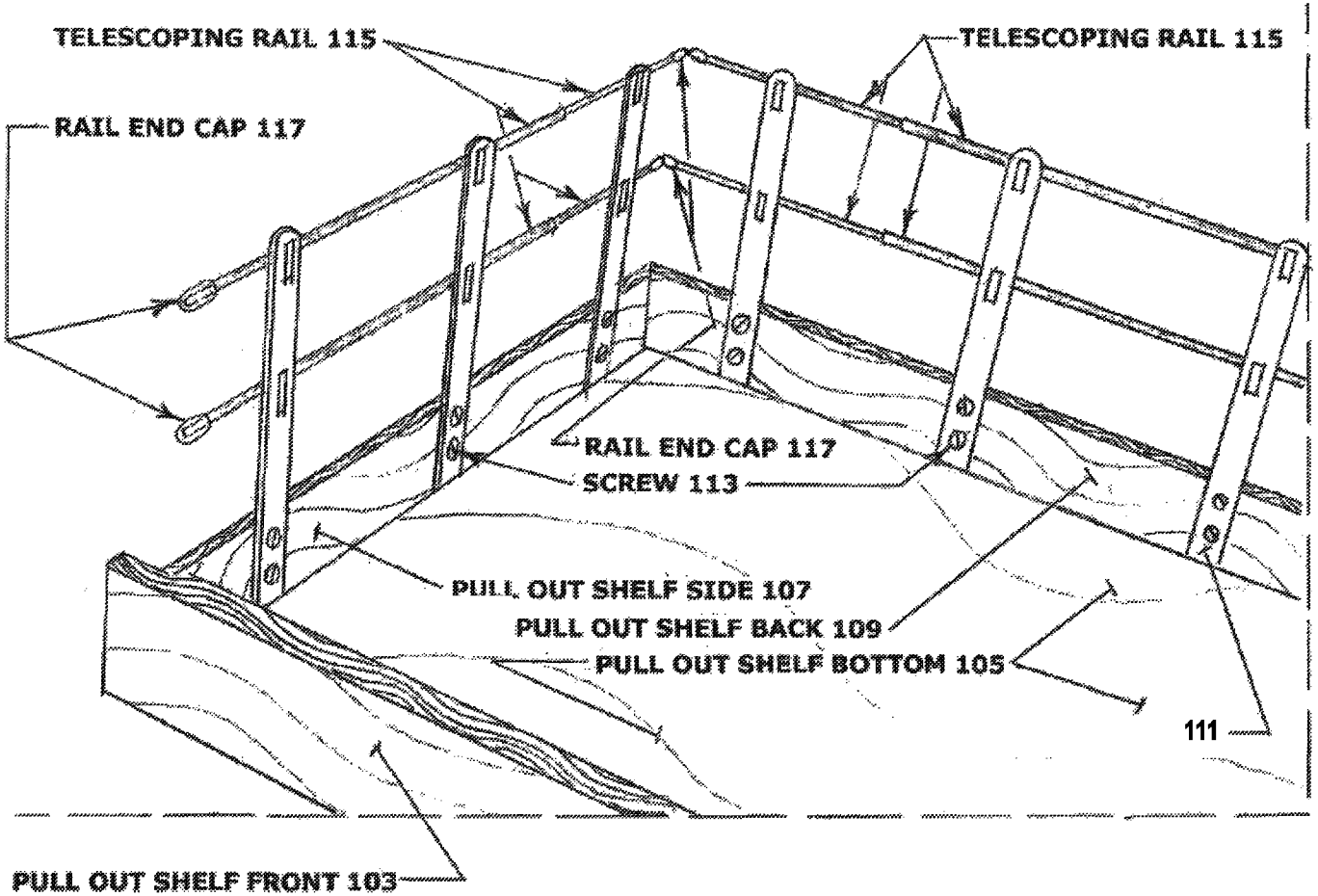
FIG. 1B is an enlargement oblique view of the top left rear corner of the containment shelf of rail containment system 101.

FIG. 1B is an enlargement oblique view of the top left rear corner of the containment shelf and rail containment system 101.

1. Existing sliding shelf, elements 103 front, 105 bottom, 107 side, and 109 back.
2. Element 111—rail standard—is attached to the shelf sides and back, every four to six inches (10 to 15 cm), with screws, and holds the rails in place.
3. Element 113—self tapping, #8, ½ inch lath screws, attach rail standards 111 to sides and back of sliding shelf.
4. Element 115—telescoping rail of metal or rigid material, to accommodate shelf varying widths and lengths.
5. Element 117—rail end cap of rubberized or plastic material, to close off the ends of the rails, and eliminate sharp edges.

Figure 1D:
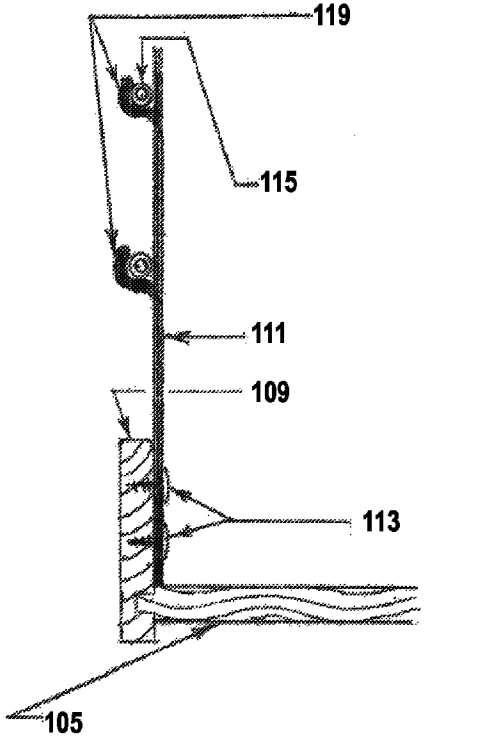
FIG. 1D is a side enlargement view of the rail standard of FIG. 1C.
Figure 1C:
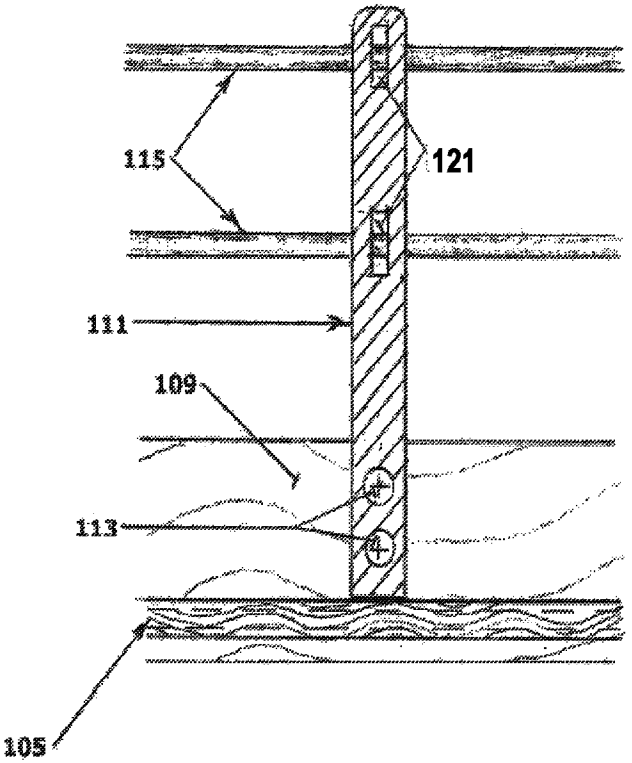
FIG. 1C is a front enlargement view of a rail standard of rail-containment system 101.

FIG. 1C is a front enlargement view of a rail standard in rail containment system 101.

FIG. 1D is a side enlargement view of the rail standard of FIG. 1C.

1. Existing sliding shelf, elements 105 bottom, 107 side, and 109 back.
2. Element 111—rail standard is a metal or rigid material, approximately ⅛ inch in thickness, by ⅞ inch in width, by 8.0 inches in height (taller standards may hold up to three rails; for example, a first containment member, a second containment member, and a third containment member).
3. Element 113—self tapping, #8, ½ inch lath screws, attach rail standards 111 (for example, a first containment-member support, a second containment-member support, and a third containment-member support) to sides and back of sliding shelf.

4. Element 115—telescoping rail of metal or rigid material, to accommodate shelf varying widths and lengths. The outside diameter of these rails may be up to ½ inch in diameter.
5. Element 119—rail cradle is a metal stamping, or molded protrusion from the rail standard 111 material, made to hold the telescoping rails. The rails can have a thin plasticized material wrapped around the rails at the location of the cradles to provide flexibility when snapping the rail into the cradle. A thicker plasticized material will be wrapped around the inner telescoping rail, to accommodate a snug fitting into the standard size cradle.

FIG. 2A, FIG. 2B, FIG. 2C, and FIG. 2D relate to the second embodiment corresponding to Provisional Application 61/965,331.

In FIG. 2A, FIG. 2B, FIG. 2C, and FIG. 2D:

1. The sliding shelf, front, back, sides, and bottom, are existing elements of a conventional sliding shelf unit.
2. Sliding shelves are built in random lengths and widths, and this invention will accommodate units from 12.0 inches to 22.5 inches in length and 12.0 inches to 30.0 inches in width. Standard system can accommodate an 8 inch high sliding shelf space. An 11.0 inch containment panel can accommodate up to a 12 inch high space.
3. Element 135—containment panel can have elongated screw hole channels to allow panel sliding movement, to accommodate shelf varying widths and lengths.
4. Drawings for this embodiment are: FIG. 2A, FIG. 2B, FIG. 2C, and FIG. 2D.

Figure 2A:
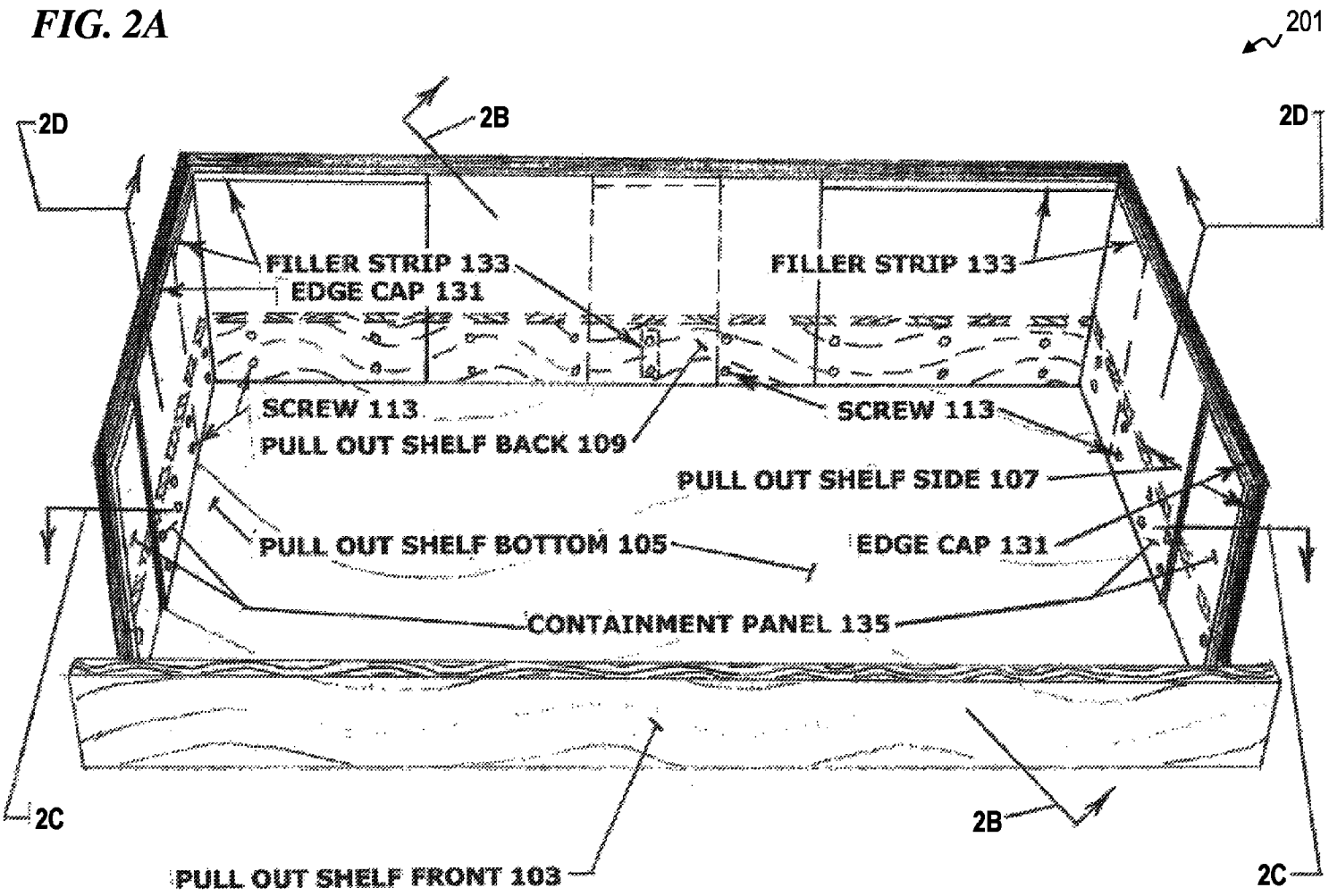
FIG. 2A is a top oblique view of a sliding shelf, with a rigid-panel containment system 201 according to one embodiment of the present invention.

FIG. 2A is a top oblique view of a sliding shelf and a rigid panel containment system 201.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches (10 to 15 cm), with screws 113, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch strip of containment panel 135 material, used under the edge cap 131, at places where overlapping panels do not occur. This strip provides a second thickness to accommodate the snap-on edge cap 131. The filler strip 133 has an etched grove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths to provide double wall thickness at screw locations, where only a single inside (closest to the center of the shelf) containment panel 135 exists.

Figure 2B:
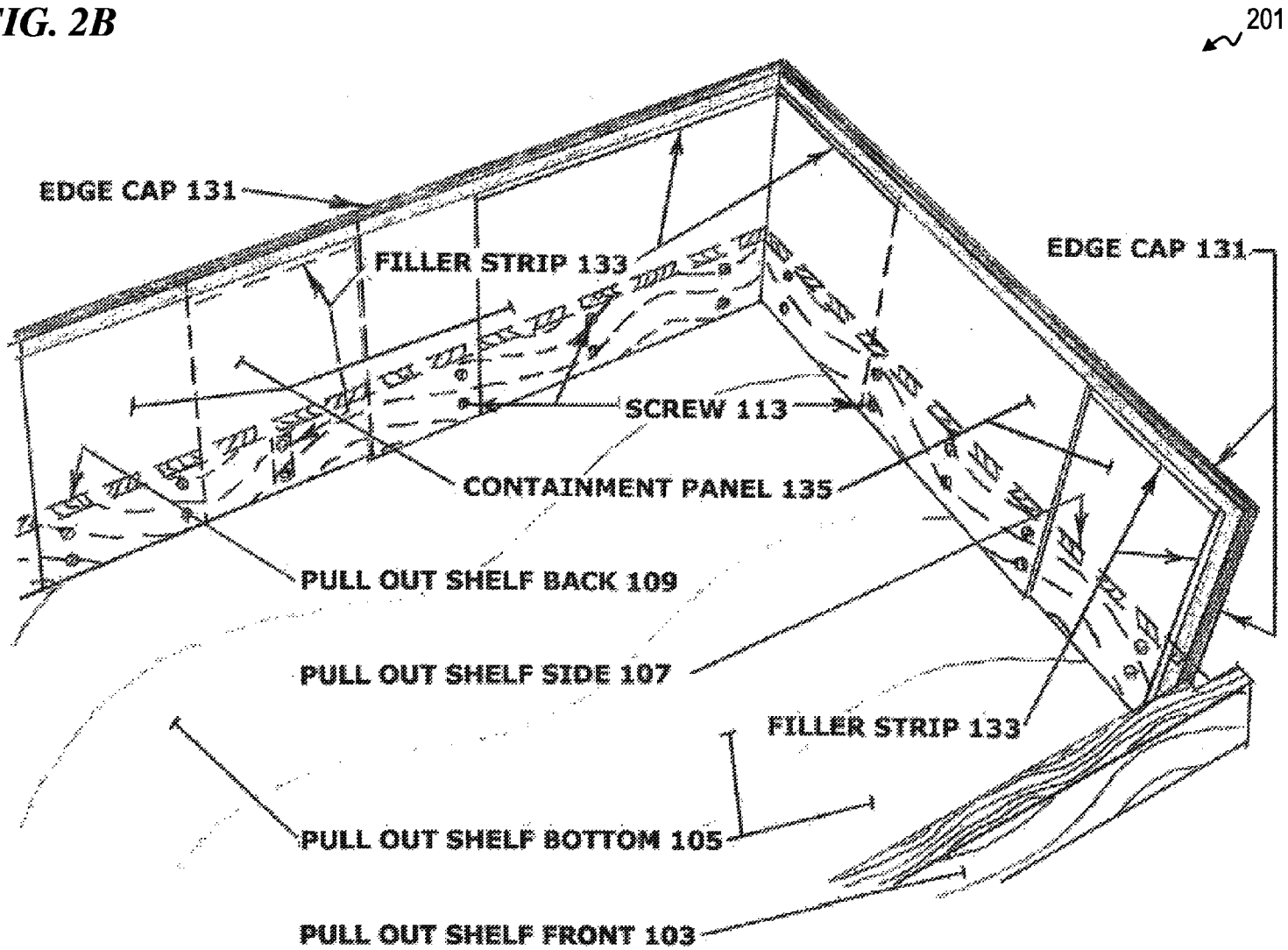
FIG. 2B is an enlargement oblique view of the top right rear corner of containment system 201, as viewed along line 2B of FIG. 2A.

FIG. 2B is an enlargement oblique view of the top right rear corner of the containment shelf and containment system 201, as viewed along line 2B of FIG. 2A.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch wide strip of containment panel 135 material, used under the edge cap 131, at places where overlapping panels do not occur. This strip provides a second thickness to accommodate the snap-on edge cap 131. The filler strip 133 has an etched groove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths to provide double wall thickness at screw locations, where only a single inside (closest to the center of the shelf) containment panel 135 exists.

Figure 2C:
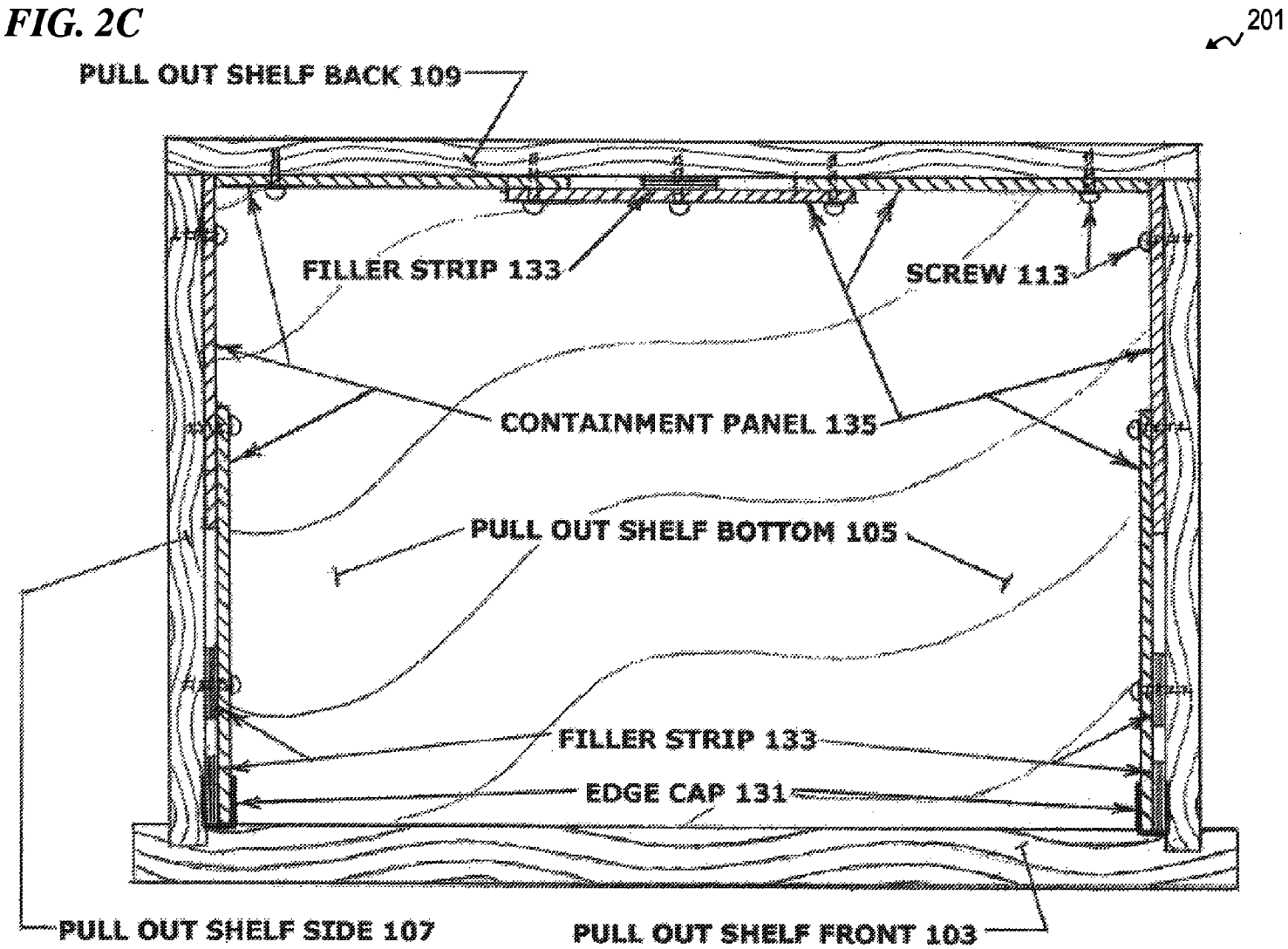
FIG. 2C is a top cross-section view of containment system 201, as viewed along line 2C of FIG. 2A.

FIG. 2C is a top cross-section view of containment system 201, as viewed along line 2C of FIG. 2A.

1. Existing sliding shelf, elements 103 front, 105 bottom, 107 side, and 109 back.
2. Element 135—is a rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.
3. Element 113—self tapping, #8, ½ inch lath screws, attach containment panels 135 to sides and back of sliding shelf.
4. Element 133—filler strip is an approximate ¾ inch wide strip of containment panel 135 material, used at places where overlapping panels do not occur. The filler strip 133 has an etched grove every ½ inch of its length, to accommodate selecting the approximate length by utilizing snap breaking joints. Filler strip 133 material is used in 2.0 inch lengths to provide double wall thickness at screw locations, where only a single inside (closest to the center of the shelf) containment panel 135 exists.

Figure 2D:
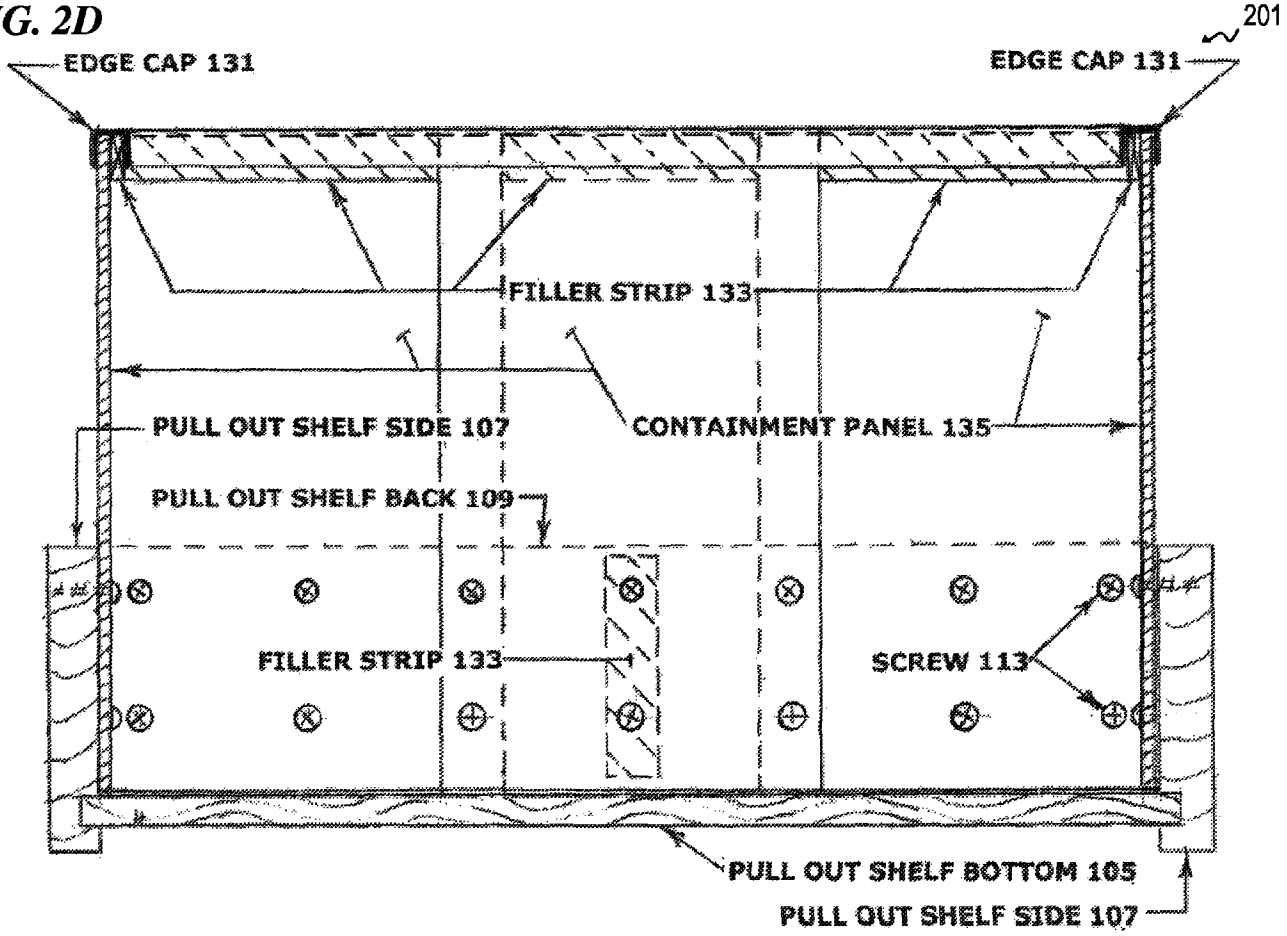
FIG. 2D is a front cross-section view of containment system 201, as viewed along line 2D of FIG. 2A.

FIG. 2D is a front cross-section view of containment system 201, as viewed along line 2D of FIG. 2A.

1. Existing sliding shelf, elements 103 front, 105 bottom, 107 side, and 109 back.
2. Element 135—is rigid material, approximately ⅛ inch in thickness that may be opaque or transparent. This material is attached to the shelf sides and back, every four to six inches, with screws, and holds the material in place. Elongated screw hole channels allow for panel sliding movement, to accommodate shelf varying widths and lengths.

3. Element 113—self tapping, #8, ½ inch lath screws, attach containment panels 135 to sides and back of sliding shelf.
4. Element 131—edge cap is a rigid plasticized material forming a U channel that has an approximate inside dimension of ¼ inch in width by ½ inch legs. This cap clips together the containment panels 135 and filler strips 133 to reinforce the containment panel 135 edges, while at the same time, eliminating sharp edges. Material can accommodate cutting to various lengths with a razor knife or similar.
5. Element 133—filler strip is an approximate ¾ inch wide strip of containment panel 135 material, used under the edge cap 131, at places where overlapping panels do not occur. This strip provides a second thickness to accommodate the snap-on edge cap 131. The filler strip 133 has an etched grove every ½ inch of its length, to accommodate selecting the approximate length by utilizing snap breaking joints. The filler strip 133 is held in place with a mastic type material of rubberized or plastic material. Filler strip 133 material is also used in 2.0 inch lengths to provide double wall thickness at screw locations, where only a single inside (closest to the center of the shelf) containment panel 135 exists.

General

Sliding shelves are typically manufactured in random sizes to fit in existing cabinetry space shelf width and length measurements. Typically, the side and back heights of these sliding shelves is 2¼ inches—plus or minus. Custom manufacturers can offer increased wall heights during the initial manufacturing process. This product is produced to retro-fit existing sliding shelves that have not been manufactured with extended walls. Typical wall heights contribute to materials tipping and falling off the shelves. This invention is to solve these tipping and falling item problems. Back to dimensions—the third dimension is to measure the height of the cabinetry space to determine the height and type of products that can be placed on these shelves. If the major problem is to solve the tipping and falling condition, then the first embodiment corresponding to Provisional Application 61/908,188—the telescoping rail system solves the problem. If the shelf is to contain horizontally stacked items, and the sliding of these items causes problems—then the second embodiment corresponding to Provisional Application 61/965,331—the containment panel system works better. This application also solves the item tipping and falling problem. Both product applications have a standard height of 8 inches from shelf bottom to top of containment. Higher containment levels can be produced for both products, to bring the rail system up to 11 inches and the panel system up to 12 inches.

Materials for the first embodiment corresponding to Provisional Application 61/908,188—telescoping rail system 101.

a. telescoping rail 115—stainless steel, steel, other metals, fiberglass, rigid plastic and other high tensile materials.
b. rail standard 111—stainless steel, coated steel, other metals, rigid plastic and other high tensile materials.
c. rail end cap 117—stretchable vinyl material with ½ inch inside length and diameter to fit over the ends of the rail.
d. screws 113—zinc coated, 8-gauge, ½ inch length phil mod truss, lath screws.

Materials for the second embodiment corresponding to Provisional Application 61/965,331—containment panel system 201.

a. containment panel 135—0.125 inch thick polycarbonate, 0.125 inch thick acrylic sheet, materials in clear or colored, 8 inch high×12 inch long and 8 inch high×10 inch long typical panels, 12 inch high panels available. All panels are predrilled, and elongated screw hole channels allow for panel sliding movement, to accommodate shelf varying widths and lengths.
b. edge cap 131—c-line Slide 'N Grip Plastic Binding Bars, 11×¼ inches, cut and shaped for vertical and horizontal ells sections.
c. filler strip 133—same material as the containment panel, ¾×12 inch pieces with scoring every ½ inch to allow for break-off lengths. Filler strips at screw location, for maintaining double thickness, are ¾×2 inch dimensions with predrilled screw holes.
d. screws 113—zinc coated, 8-gauge, ½ inch length phil mod truss, lath screws.

Assembly for the first embodiment corresponding to Provisional Application 61/908,188—telescoping rail system 101.

a. measure the inside of the existing sliding shelf. Shelf rail standards 111, to be installed four to six inches center to center. Shorter length and width shelves will have sides and or back lengths that may have three rail standards 111 as close as four inches center to center. Using a pencil, mark rail standard 111 locations, beginning 2¼ inches from each inside corner, to the center of the first rail standard. Divide the remaining distance by 6, and increase to the next whole number. Divide the remaining length by this whole number, to get the spacing for the rail segment. Example for a 30 inch back width shelf—30 minus 4½ (2¼ inches from each corner), equals 25½ inches, divided by 6 is 4¼. Increase to next whole number is 5. Twenty-five and one half inches divided by 5 is a 5.1 inch spacing for this back section. Measure the shelf sides and repeat the same process to obtain spacings. Mark all spacings for rail standards 111 on the shelf bottom, immediately adjacent to the shelf sides and back sections.
b. Install rail standards 111 at all spacing marks. Hold a rail standard 111 in place, lining up the space marking with the center of the rail standard 111, and mark the bottom drill hole. Drill at the bottom hole and install the rail standard (with the rail cradle protrusion to the outside of the shelf) with a screw. Snug up the screw to hold the rail standard 111 in place. Plumb the rail standard 111 to vertical using any 90 degree angle item (like a deck of cards, credit card, note pad, small square, etc.). Mark, drill, and install screw in upper rail standard hole. Check for vertical 90 degrees, and tighten both screws. Complete this process for the remaining rail standard 111 installations.
c. Lay out rails next to all three shelf walls. For side sections, partially insert a smaller diameter rail into a large one. Install rail end caps on each end (smaller end cap onto smaller rail, and larger cap onto larger rail end). Lay the side sections into the rail cradles 119, of the shelf standards 111, with the larger diameter rail toward the front of the shelf. Assemble the shelf back wall rails (three rail sections will have a small diameter rail on each end). Two rail sections will be the same as the side wall sections. Install rail end caps 117 as necessary, and lay the back rails into the back rail standard 111 rail cradles 119 (two section rails can have the small diameter at either end of the back section).
d. Extend the telescoping rails to be flush with the back side of the pull out shelf front. Extend corner telescoping rails to meet at the corners. Pencil-mark each rail at the center of the rail cradle 119.

e. Remove one side rail assembly. Two thicknesses of cradle tape are supplied. Use the thin tape and wrap one revolution over each pencil marking on the large diameter rails. Do the same for the small diameter rails—using the thick tape. Reinstall the side rail assembly, by pressing it down to the bottom of each receiving cradle. Repeat the same process for the other side and back of the shelf.

Assembly for the second embodiment corresponding to Provisional Application 61/965,331 containment panel system.

a. measure the inside of the existing sliding shelf. Twelve inch deep shelves require only one side 8 inch×12 inch containment panel 135. Twelve and a half to 22½ inch depth requires two containment panels 135. Twelve inch wide shelves require only one 8 inch×12 inch containment panel. Twelve and a half to 20.0 inch require 2 containment panels 135 (1-8×12 and 1-8×10 inch). Twenty to 22 inch widths require 2 containment panels 135 (2-8×12 inch). Twenty-two to 30 inch widths require 3 containment panels 135 (2-8×12 and 1-8×10 inch).

b. Measure the inside depth of sliding drawer. If the side dimension is 14½ inches or more, install 8×12 side panel at the right rear corner, using the 8 inch side as the panel height. Drill and install the upper screw hole 2¼ inches from the corner. Hold up the second panel (panel closest to the middle of the slide out shelf), against and touching the back of the pull out shelf front 103. Pencil mark proposed screw holes, in the double thickness portion, 2 inches from the overlap, and evenly along the side panel every 4 to 6 inches. Attach glue side of 2 inch long filler strips 133 to the outside (closest to the pull out shelf side 107) of the panel at screw locations where the inside panel is single thickness. Drill and install one screw at a location close to the midpoint of where the panels overlap. This will hold both panels in place while you drill and install the remaining screws at marked points, using the predrilled panel holes as a guide. Repeat the same installation on the opposite pull out shelf side 107.

c. For side depths of less than 14½ inches and more than 12½ inches—temporarily install corner side panel using the top screw hole 2 inches from the corner. Hold up the second 8×12 inch panel and pencil mark screw holes and attach filler strips 133, as described in 4.b. (above). Remove screw holding the first panel. Hold up both panels and drill and install a screw at a marked hole near the midpoint of the double thickness area. This will hold both panels in place until all screws are installed. Repeat the same installation on the opposite pull out shelf side 107.

d. For back panel installation where the back dimension is less than 14½ inches and more than 12½ inches—start the right rear corner, hold the first panel against the pull out shelf back 109, with the end touching the installed side panel and repeat the steps contained in 4.c. above.

e. For back panel installation where the dimension is less than 22 inches and more than 14½ inches—start the first 8×12 panel against the pull out shelf back 109 right rear corner. Drill and install the upper screw hole 2¼ inches from the corner. Hold up the second 8×12 panel (panel closest to the middle of the slide out shelf), against and touching the left rear corner. Pencil mark proposed screw holes at the mid point of the double thickness portion, and evenly along the back panel every 4 to 6 inches. Attach glue side of 2 inch long filler strips to the outside (closest to the pull out shelf back 109) of the inside panel at screw locations where the inside panel is single thickness. Drill and install one screw at a location close to the midpoint of the panel. This will hold both panels in place while you drill and install the remaining screws at marked points, using the predrilled panel holes as a guide.

f. For back panel installation where the dimension is less than 30 inches or more than 24 inches—install an 8×12 panel against the pull out shelf back 109 in each corner. Drill and install the upper screw hole 2¼ inches from each corner. Center the third 8×10 panel in the gap between the first two panels. Pencil mark all screw hole locations and install filler strips as necessary in the gap between the first two panels. Attach glue side of 2 inch long filler strips to the outside (closest to the pull out shelf back 109) of the panel. Drill and install one screw at a marked location close to the midpoint of the panel. This will hold all panels in place while you drill and install the remaining screws at marked points, using the predrilled panel holes as a guide.

g. Before you install the top and front edge cap 131, additional filler strips must be installed to provide a gripping surface for the edge cap 131. All areas along the edge cap 131, must receive filler strips to make the edge a double thickness. Starting on the side panel at the right rear corner of the sliding shelf—this single section will receive a filler strip 133, on the side closest to the sliding shelf center. Hold the break-off strip against the single panel and mark the length with a pencil. If this mark falls in between break-off points, go to the next shortest break-off point on the strip and (using two pliers) break the strip at that location. That will allow the strip to fit into the gap. Install the glue side to the inside of the corner side panel. Moving toward the front of the sliding shelf, repeat the measurement, break off, and glue attachment for the strip on the outside of the second panel. Then repeat the measurement, brake-off, and glue attachment for the vertical front strip. Move to the other side and repeat the same procedure. Now move to the back right corner of the shelf, and repeat the measurement, break-off, and glue and attach the strip on the inside of the first panel attached to the back of the shelf. Then repeat the measurement, brake-off, and glue attachment for the intire horizontal strip. As you move toward the shelf left back corner, alternate sides (when there are two or three back panels) when applying filler strips 133.

h. When all filler strips are installed, there should be a continuous double thickness of containment panels 135 and filler strips 133, all along the top of the containment panels 135, and from the top of the front two containment panels 135, down to the top of the pull out shelf front.

i. Begin installing edge caps 131. Use the ell edge cap 131 consisting of the vertical and horizontal angle—to be applied to the front two corners of the containment panels. Measure the distance from the top of the front two containment panels 135, down to the top of the pull out shelf front. Using a razor knife, carefully cut the ell edge cap 131, to the measurement. Install edge cap 131, starting at the top of the pull out shelf front. Spread the bottom corner legs of the edge cap, and insert it over the containment panel 135, and filler strip 133, at the bottom of the vertical section. Gently apply pressure on the back of the edge cap 131, as you move up the edge cap. When the edge cap is fully seated on the vertical portion of the panel, gently apply pressure on the back of the edge cap 131, as you move horizontally toward the rear corner of the shelf. When this edge cap is fully seated, install the horizontal ell edge cap 131 on the back corners, using the same procedure. There will be gaps between the ell edge caps 131 on the tops of the panels on the sides and back of the shelf. Measure the gap distance, and (using a razor knife) carefully cut and install a section of straight edge cap 131, to the measurement. Two straight sections of edge cap 131 may be required on the back panels of wide shelves. Apply pressure to all edge cap 131 sections to complete the installation.

What is claimed is:

1. A kit to be retro-fit onto a sliding shelf, wherein the sliding shelf includes a bottom area and a plurality of walls that form a containment perimeter of the sliding shelf to a first height above the bottom area, wherein each wall of the plurality of walls has an inner surface and an outer surface, wherein each wall of the plurality of walls has a plane that passes vertically through the wall, wherein the kit is configured to increase the first height of the containment perimeter to a second height above the bottom area, and wherein the kit comprises:

a plurality of straight vertical containment-member supports including a first containment-member support and a second containment-member support, wherein each respective containment-member support of the plurality of containment-member supports has an inner surface and an outer surface, wherein each respective containment-member support has holes for receiving a plurality of fasteners, and wherein each respective containment-member support is configured to be attached, using the plurality of fasteners, to the inner surface of a respective wall of the plurality of walls such that an entirety of the respective straight containment-member support extends along a line that parallels the plane of the respective wall; and a plurality of overlapping containment members including a first containment member and a second containment member, wherein each one of the plurality of overlapping containment members include two parts that have a tubular shape and are coaxially overlapping configured to slide in a lengthwise direction relative to one another such that the plurality of overlapping containment members form a plurality of telescoping rails, wherein at least the first containment member is configured to be coupled to at least the first containment-member support, wherein the plurality of walls that form the containment perimeter of the sliding shelf includes a first side wall, a second side wall, and a back wall, wherein the plurality of containment-member supports further includes a third containment-member support, wherein the first containment-member support is configured to be attached to the inner surface of the first side wall, wherein the second containment-member support is configured to be attached to the inner surface of the second side wall, wherein the third containment-member support is configured to be attached to the inner surface of the back wall, wherein the plurality of overlapping containment members further includes a third containment member, wherein the first containment member is removably coupled to the outer surface of the first containment-member support, wherein the second containment member is removably coupled to the outer surface of the second containment-member support, and wherein the third containment member is removably coupled to the outer surface of the third containment-member support that is attached to the back wall of the sliding shelf.

2. The kit of claim 1, wherein the plurality of containment members further includes a fourth containment member, wherein the first containment-member support includes a plurality of rail cradles including a first rail cradle located at a first vertical location along the outer surface of the first containment-member support and a second rail cradle located at a second vertical location along the outer surface of the first containment-member support, wherein the first vertical location is different than the second vertical location, wherein the first rail cradle is configured to removably couple the first containment member to the first containment-member support at the first vertical location, and wherein the second rail cradle is configured to removably couple the fourth containment member to the first containment-member support at the second vertical location.

3. The kit of claim 1, wherein each respective one of the plurality of containment-member supports includes a plurality of rail cradles including:

a first rail cradle located at a first vertical location along the outer surface of the respective containment-member support, and a second rail cradle located at a second vertical location along the outer surface of the respective containment-member support, wherein the first vertical location is at a different height than the second vertical location, wherein the first rail cradle is configured to removably couple the first containment member to the respective containment-member support at the first vertical location, wherein the second rail cradle is configured to removably couple the second containment member to the respective containment-member support at the second vertical location, and wherein the first containment member includes a rubberized tape wrapped around the first containment member at a location at which the first containment member is removably coupled to the first rail cradle.

4. The kit of claim 1, further comprising the plurality of fasteners, wherein the plurality of fasteners are screws that are configured to attach each respective containment-member support to the respective wall through the holes of the respective containment-member support.

5. The kit of claim 1, wherein the plurality of containment-member supports is made from stainless steel, and wherein the plurality of containment members is made from stainless steel.

6. The kit of claim 1, wherein the sliding shelf is configured to be placed in a cabinet space, wherein the kit, when assembled in the sliding shelf, does not extend beyond a width of the sliding shelf such that the sliding shelf can be placed in the cabinet space with the assembled kit attached to the sliding shelf.

7. The kit of claim 1, further including a plurality of end caps, wherein the first containment member includes a first end and a second end, wherein each of the first and second ends of the first containment member includes one of the plurality of end caps.

8. The kit of claim 1, further comprising:

the plurality of fasteners, wherein the plurality of fasteners are screws that are configured to attach each respective containment-member support to the respective wall through the holes of the respective containment-member support, wherein the first containment member includes a first end and a second end, and wherein each of the first and second ends of the first containment member includes an end cap.

9. The kit of claim 1, wherein the first containment-member support is approximately eight (8) inches in height.

10. The kit of claim 1, wherein an outside diameter of each one of the plurality of containment members is no more than one-half (½) inch.

11. The kit of claim 1, wherein the first containment-member support includes a plurality of rail cradles, and wherein each one of the plurality of rail cradles is a molded protrusion from the first containment-member support.

12. A kit to be retro-fit onto a sliding shelf, wherein the sliding shelf includes a bottom area and a plurality of walls that form a containment perimeter of the sliding shelf to a first height above the bottom area, wherein each wall of the plurality of walls has an inner surface and an outer surface, wherein each wall of the plurality of walls has a plane that passes vertically through the wall, wherein the kit is configured to increase the first height of the containment perimeter to a second height above the bottom area, and wherein the kit comprises:

a plurality of straight vertical containment-member supports including a first containment-member support and a second containment-member support, wherein each respective containment-member support of the plurality of containment-member supports has an inner surface and an outer surface, wherein each respective containment-member support has holes for receiving a plurality of fasteners, and wherein each respective containment-member support is configured to be attached, using the plurality of fasteners, to the inner surface of a respective wall of the plurality of walls such that an entirety of the respective straight containment-member support extends along a line that parallels the plane of the respective wall; and a plurality of overlapping containment members including a first containment member and a second containment member, wherein each one of the plurality of overlapping containment members include two parts that have a tubular shape and are coaxially overlapping configured to slide in a lengthwise direction relative to one another such that the plurality of overlapping containment members form a plurality of telescoping rails, wherein at least the first containment member is configured to be coupled to at least the first containment-member support, wherein the plurality of overlapping containment members further includes a third containment member, wherein the first containment member is configured to be coupled to the outer surface of the first containment-member support at a first vertical location along the first containment-member support, wherein the second containment member is configured to be removably coupled to the outer surface of the first containment-member support at a second vertical location along the first containment-member support, wherein the third containment member is configured to be removably coupled to the outer surface of the first containment-member at a third vertical location along the first containment-member support, and wherein each of the first, second, and third vertical locations is a unique location.

13. The kit of claim 12, wherein the first containment-member support includes a plurality of rail cradles including a first rail cradle located at the first vertical location along the outer surface of the first containment-member support and a second rail cradle located at the second vertical location along the outer surface of the first containment-member support, wherein the first rail cradle is configured to removably couple the first containment member to the first containment-member support at the first vertical location, and wherein the second rail cradle is configured to removably couple the second containment member to the first containment-member support at the second vertical location.

14. The kit of claim 12, wherein each respective one of the plurality of containment-member supports includes a plurality of rail cradles including:

a first rail cradle located at the first vertical location along the outer surface of the first containment-member support, and a second rail cradle located at the second vertical location along the outer surface of the first containment-member support, wherein the first containment member includes a rubberized tape wrapped around the first containment member at a location on the first containment member at which the first containment member is removably coupled to the first rail cradle.

15. The kit of claim 12, further comprising the plurality of fasteners, wherein the plurality of fasteners are screws that are configured to attach each respective containment-member support to the respective wall through the holes of the respective containment-member support.

16. The kit of claim 12, wherein the plurality of containment-member supports is made from stainless steel, and wherein the plurality of containment members is made from stainless steel.

17. The kit of claim 12, further including a plurality of end caps, wherein the first containment member includes a first end and a second end, wherein each of the first and second ends of the first containment member includes one of the plurality of end caps.

18. The kit of claim 12, wherein an outside diameter of each one of the plurality of containment members is no more than one-half (½) inch.

19. The kit of claim 12, wherein the first containment-member support includes a plurality of rail cradles, and wherein each one of the plurality of rail cradles is a metal stamping.

20. A method for installing a containment system onto a sliding shelf, wherein the sliding shelf includes a bottom area and a plurality of walls that form a containment perimeter of the sliding shelf to a first height above the bottom area, wherein the plurality of walls includes a first side wall, a second side wall, and a back wall, wherein each wall of the plurality of walls has an inner surface and an outer surface, wherein each wall of the plurality of walls has a plane that passes vertically through the wall, wherein the containment system is configured to increase the first height of the containment perimeter to a second height above the bottom area, wherein the containment system includes:

a plurality of straight vertical containment-member supports including a first containment-member support, a second containment-member support, and a third containment-member support, wherein each respective containment-member support of the plurality of containment-member supports has an inner surface and an outer surface, and wherein each respective containment-member support has holes for receiving a plurality of fasteners, and a plurality of overlapping containment members including a first containment member, a second containment member, and a third containment member, wherein each one of the plurality of overlapping containment members include two parts that have a tubular shape and are coaxially overlapping configured to slide in a lengthwise direction relative to one another such that the plurality of overlapping containment members form a plurality of telescoping rails, the method comprising:

measuring the sliding shelf to determine a spacing for the plurality of containment-member supports;

marking the spacing for the plurality of containment-member supports on the sliding shelf;

attaching, using the plurality of fasteners and the holes, the first containment-member support to the inner surface of the first side wall based on the marked spacing such that an entirety of the first containment-member support extends along a line that parallels the plane of the first side wall;

attaching, using the plurality of fasteners and the holes, the second containment-member support to the inner surface of the second side wall based on the marked spacing such that an entirety of the second containment-member support extends along a line that parallels the plane of the second side wall;

attaching, using the plurality of fasteners and the holes, the third containment-member support to the inner surface of the back wall based on the marked spacing such that an entirety of the third containment-member support extends along a line that parallels the plane of the back wall;

removably coupling the first containment member to the outer surface of the first containment-member support;

removably coupling the second containment member to the outer surface of the second containment-member support; and removably coupling the third containment member to the outer surface of the third containment-member support.

* * * * *